US007798073B2

(12) United States Patent
Swailes et al.

(10) Patent No.: US 7,798,073 B2
(45) Date of Patent: Sep. 21, 2010

(54) MOUNTABLE TABLE FOR THE REAR OF A VEHICLE

(75) Inventors: Steven Richard Swailes, Metamora, MI (US); Mick Robert Zuk, Romulus, MI (US); Joseph Leo Neighbors, Milford, MI (US); Steven M. Jakubiec, Bloomfield, MI (US); David W. Smith, Shelby, MI (US)

(73) Assignee: Chrysler Group LLC, Auburn Hills, MI (US)

( * ) Notice: Subject to any disclaimer, the term of this patent is extended or adjusted under 35 U.S.C. 154(b) by 568 days.

(21) Appl. No.: 11/743,277

(22) Filed: May 2, 2007

(65) Prior Publication Data

US 2008/0271645 A1 Nov. 6, 2008

(51) Int. Cl.
*A47B 23/00* (2006.01)

(52) U.S. Cl. ..... 108/44

(58) Field of Classification Search ..... 224/488, 224/519, 512, 513, 556; 296/26.08; 108/44–46; 248/534, 536, 539, 221.11, 222.11, 235, 248/240.3; 135/88.05, 88.08, 88.07, 88.17
See application file for complete search history.

(56) References Cited

U.S. PATENT DOCUMENTS

| | | | | |
|---|---|---|---|---|
| 2,121,317 | A * | 6/1938 | Cohen | 248/539 |
| 2,375,565 | A * | 5/1945 | Liakopulos | 248/282.1 |
| 2,625,986 | A * | 1/1953 | Siff | 108/139 |
| 4,519,409 | A * | 5/1985 | Kinney et al. | 135/88.08 |
| D309,065 | S | 7/1990 | Huff | |
| D338,358 | S | 8/1993 | Schroeder et al. | |
| D338,574 | S | 8/1993 | Schroeder et al. | |
| 5,370,060 | A | 12/1994 | Wang | |
| 5,501,500 | A * | 3/1996 | Cannon | 296/26.08 |
| 5,573,301 | A * | 11/1996 | Scott | 297/173 |
| D389,452 | S | 1/1998 | Scott | |
| 5,730,066 | A * | 3/1998 | Auten et al. | 108/44 |
| 5,738,261 | A * | 4/1998 | Dula | 224/533 |
| 5,749,697 | A * | 5/1998 | Davis | 414/680 |
| 6,095,059 | A * | 8/2000 | Riley | 108/44 |
| 6,641,190 | B2 * | 11/2003 | Kirchhoff | 296/26.11 |
| 6,648,391 | B1 * | 11/2003 | Whiteford et al. | 296/26.08 |
| 6,722,290 | B2 * | 4/2004 | Wetterlund | 108/44 |
| 2001/0042985 | A1 * | 11/2001 | Hodge | 296/26.08 |
| 2003/0080263 | A1 * | 5/2003 | McCoy | 248/205.1 |
| 2006/0107984 | A1 * | 5/2006 | Avery | 135/96 |
| 2007/0152002 | A1 * | 7/2007 | Dollar | 224/404 |
| 2009/0140538 | A1 * | 6/2009 | Larson | 296/26.08 |

OTHER PUBLICATIONS

PCT/GB01/03627 Western Feb. 21, 2002.*

* cited by examiner

*Primary Examiner*—Janet M Wilkens
(74) *Attorney, Agent, or Firm*—Ralph E. Smith

(57) ABSTRACT

The present disclosure provides a mountable recreation table that mounts on the rear of the vehicle while the vehicle is parked and the tailgate is open. The recreation table includes a table top and a table pole attached to the underside of the table top. A table mount attaches to the rear of the vehicle, and the mount includes a receiver for the table pole to be inserted into. The mount is secured to either a striker or a seat headrest in the rear of the vehicle. Advantageously, the recreation table of the present disclosure easily attaches to the rear of the vehicle. The recreation table can be utilized in combination with seats in the rear of the vehicle, and the present disclosure requires no modification to attach the table to the vehicle.

18 Claims, 7 Drawing Sheets

MOUNTABLE TABLE FOR THE REAR OF A VEHICLE

FIELD OF THE INVENTION

The present disclosure relates generally to the automotive field. More specifically, the present disclosure relates to a table mounted on the rear of a vehicle. The table easily mounts on the rear of a parked vehicle using a detachable mount placed on the rear frame of the vehicle.

BACKGROUND OF THE INVENTION

Vehicles, such as mini-vans, sport utility vehicles (SUVs), and the like, include a tailgate which provides access to the rear of the vehicle. Recreational activities, such as tailgating, picnicking, barbequing, camping, and the like, are often done from the rear of the vehicle with the tailgate open. For example, a tailgate party is an often celebratory social event held on and around the open tailgate of the vehicle. Tailgate parties usually occur in the parking lots of stadiums and arenas before, and occasionally after or during, sporting events (e.g., football games, baseball games, NASCAR, etc.). While camping, in another example, the rear of the vehicle with the tailgate open can be utilized for recreation or eating. Additionally, the vehicle can include a row of seats that are stored in the storage bins in the rear of the vehicle by folding and tumbling backward. These seats can be utilized in the rear of the vehicle for tailgating or the like. Alternatively, the vehicle can include back seats that swivel around to face the rear of the vehicle.

U.S. Design Pat. No. 389,452 to Scott provides an ornamental design for an automobile tailgate party table. U.S. Pat. No. 5,370,060 to Wang provides a foldaway table for an automobile which mounts to a headrest of a car seat. U.S. Design Pat. Nos. 338,574 and 338,358, both to Schroeder et al., provide ornamental designs for a table in an automobile. U.S. Design Pat. No. 309,065 to Huff provides an adjustable table for attachment to an automobile tailgate. Disadvantageously, tables described in these references require multiple support elements, and are not easily attached to the vehicle. Thus, a table is needed which includes a single support element, and a mechanism to easily mount and dismount from the vehicle.

BRIEF SUMMARY OF THE INVENTION

In various exemplary embodiments, the present disclosure provides a mountable recreation table that mounts on the rear of the vehicle while the vehicle is parked and the tailgate is open. The recreation table includes a table top and a table pole attached to the underside of the table top. A table mount attaches to the rear of the vehicle, and the mount includes a receiver for the table pole to be inserted into. The mount is secured to either a striker or a seat headrest in the rear of the vehicle. Advantageously, the recreation table of the present disclosure easily attaches to the rear of the vehicle. The recreation table can be utilized in combination with seats in the rear of the vehicle, and the present disclosure requires no modification to attach the table to the vehicle.

In an exemplary embodiment of the present disclosure, a mountable table operable to mount and dismount from the rear of a vehicle includes a table top, a table pole attached to the underside of the table top, a mount including a distal end connected to a proximal end through a plurality of sections shaped substantially to match the shape of a rear frame of the vehicle, a receiver attached at the distal end, wherein the receiver extends substantially vertically from the distal end and includes an opening sized to receive the table pole, and an opening at the proximal end sized to fit over a striker on the vehicle. The mountable table farther includes a stabilizer beam extending from the receiver to one of the plurality of sections of the mount, wherein the stabilizer beam is operable to provide horizontal support to the receiver. The stabilizer beam includes a wire beam which wraps around the receiver. The table pole is attached on the underside of fee table, top substantially near the center. Optionally, the table pole is removable from the table top. Alternatively, the table pole is rotatable about the underside of the table top. The vehicle includes a storage compartment for the table top, table pole, and table mount. The mount is located on the rear frame of the vehicle, and wherein the mount attaches to the rear frame without requiring modification of the vehicle. The mount includes a padding layer substantially covering the underside of the mount. The vehicle includes seats in the rear compartment, and wherein the mountable table is located to coordinate with the seats.

In another exemplary embodiment of the present disclosure, a method for mounting a table on the rear of a vehicle includes opening a rear tailgate on the vehicle, placing a mount on a rear frame of the vehicle, wherein an opening in a proximal, end of the mount is placed over a striker in the vehicle rear compartment and a distal end of the mount extends outward from the rear frame of the vehicle, securing the mount to the striker, placing a table pole in a receiver located on the distal end of the mount, and securing the table pole to the receiver. The method further includes un-securing the table pole from the receiver, removing the table pole from the receiver, un-securing the mount from the striker, removing the mount from the rear frame of the vehicle, and storing the table pole, mount, and a table top connected to the table pole in the vehicle. Optionally, the storing step includes rotating the table pole to be substantially parallel with the table top, and storing the table top with the table pole folded against the top in the vehicle. Alternatively, the storing step includes removing the table pole from the table top, and storing the table top and table pole in the vehicle.

In yet another exemplary embodiment of the present disclosure, a mount for securing a table to the rear of a vehicle includes a distal end including a receiver, wherein the receiver extends substantially perpendicular from the distal end and includes a receiver opening operable to receive a pole, a plurality of intermediate sections extending from the distal end to a rear frame of the vehicle, wherein the plurality of intermediate sections are shaped substantially to match the shape of the rear frame, a proximal end connected to the plurality of intermediate sections, wherein the proximal end includes a securing opening which is placed over a striker in the vehicle, and a stabilizer beam connected to the receiver and one of the plurality of intermediate sections. The mount further includes a table pole attached to the underside of a table top, wherein the table pole is placed in the receiver opening. The mount further includes a padding layer covering substantially all of the underside of the mount. The mount is secured to the rear frame of the vehicle with an attachment device operable to secure the securing opening. The attachment device includes a latch connected to the proximal end, and wherein the latch includes a curved portion configured to rotate to fit within the striker in a first position and to rotate out of the striker in a second position.

BRIEF INSCRIPTION OF THE DRAWINGS

The present disclosure is illustrated and described herein with reference to the various drawings, in which like reference numbers denote like system components, respectively, and in which.

DETAILED DESCRIPTION OF THE INVENTION

In various exemplary embodiments, the present disclosure provides a mountable recreation table that mounts on the rear of the vehicle while the vehicle is parked and the tailgate is open. The recreation table includes a table top and a table pole attached to the underside of the table top. A table mount attaches to the rear of the vehicle, and the mount includes a receiver for the table pole to be inserted into. The mount is secured to either a striker or a seat headrest in the rear of the vehicle. Advantageously, the recreation table of the present disclosure easily attaches to the rear of the vehicle through the receiver for the table pole located in the table mount. The recreation table can be utilized in combination with seats in the rear of the vehicle, and the present disclosure requires no modification to attach the table to the vehicle.

Figure 1:
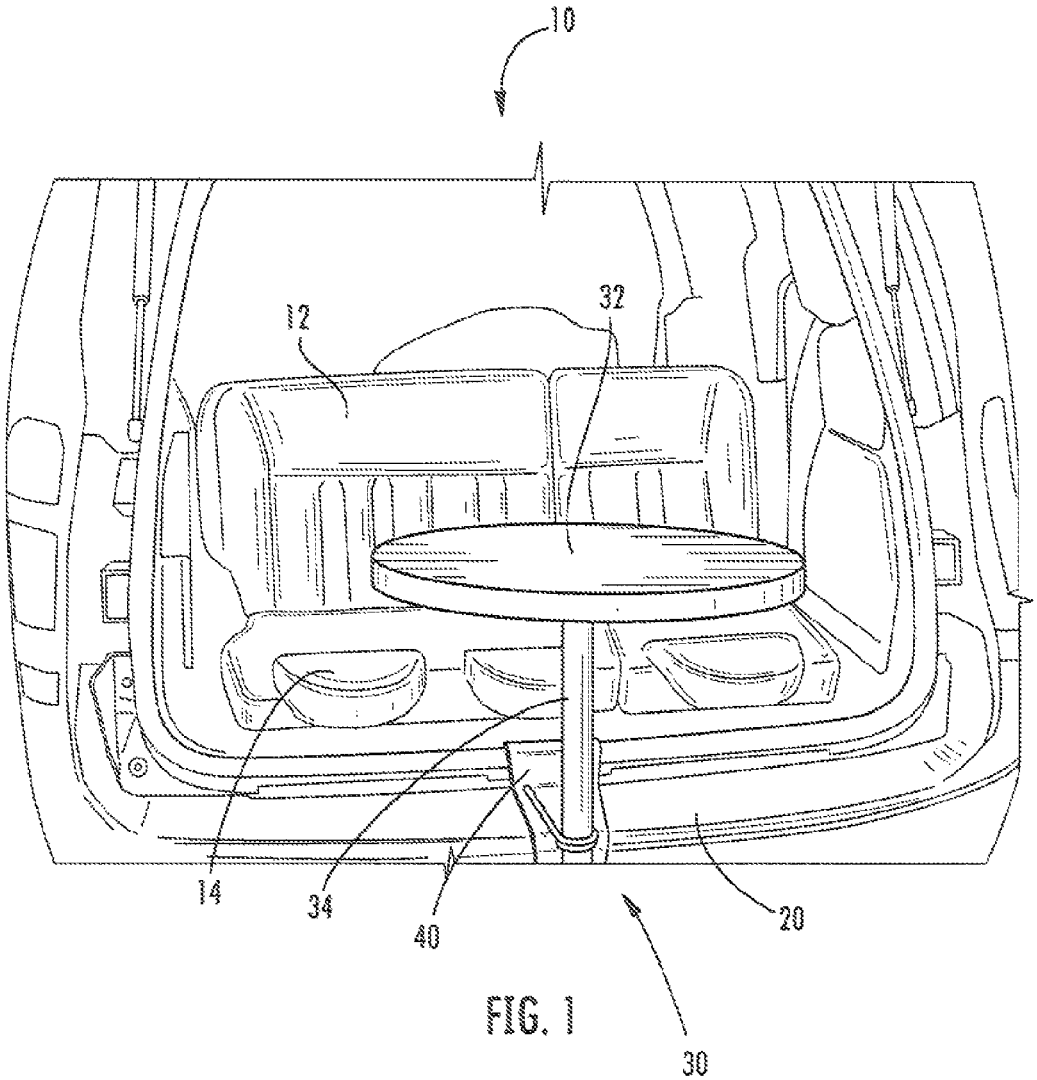
FIG. 1 is a perspective view of an exemplary embodiment of the mountable table on the rear of a vehicle.
Figure 2:
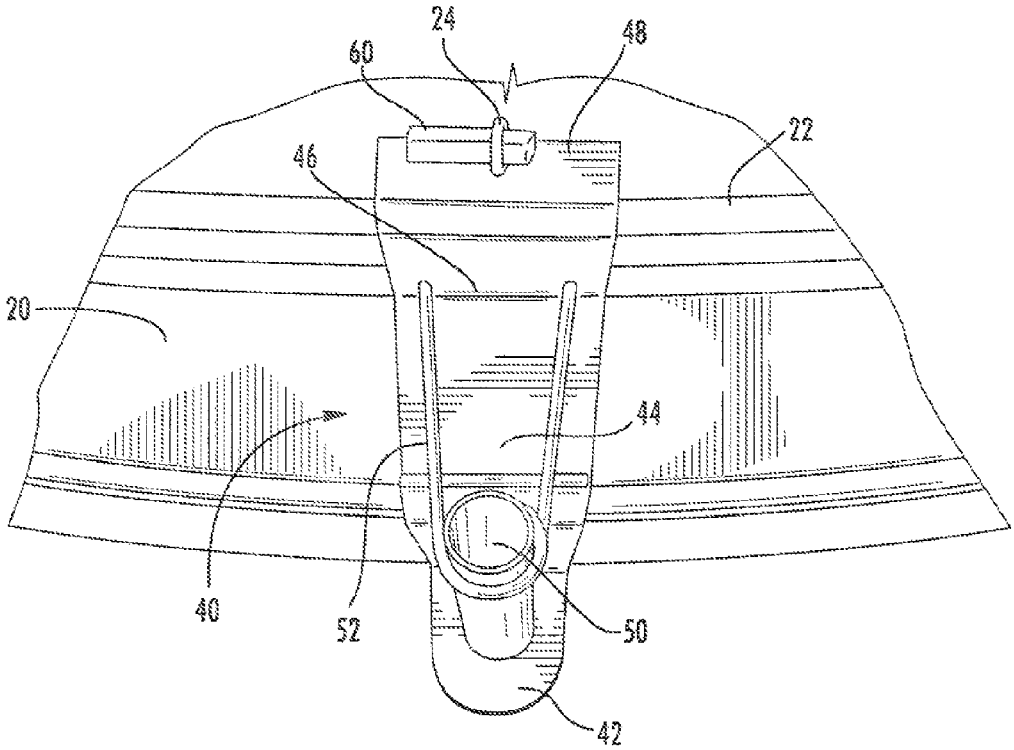
FIG. 2 is a top perspective view of a mount connected to the rear of the vehicle and secured to a striker on the vehicle.
Figure 3:
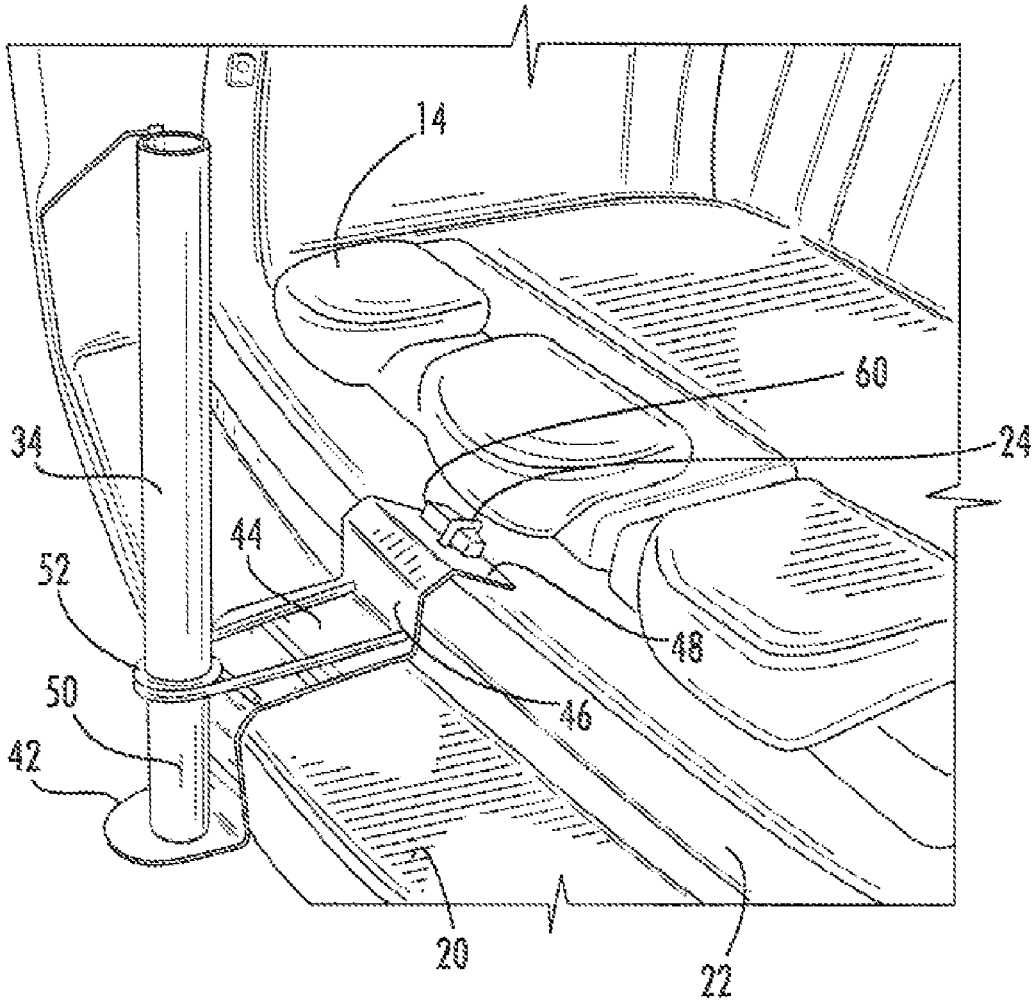
FIG. 3 is a perspective view of a pole inserted into a receiver attached to the mount.
Figure 4:
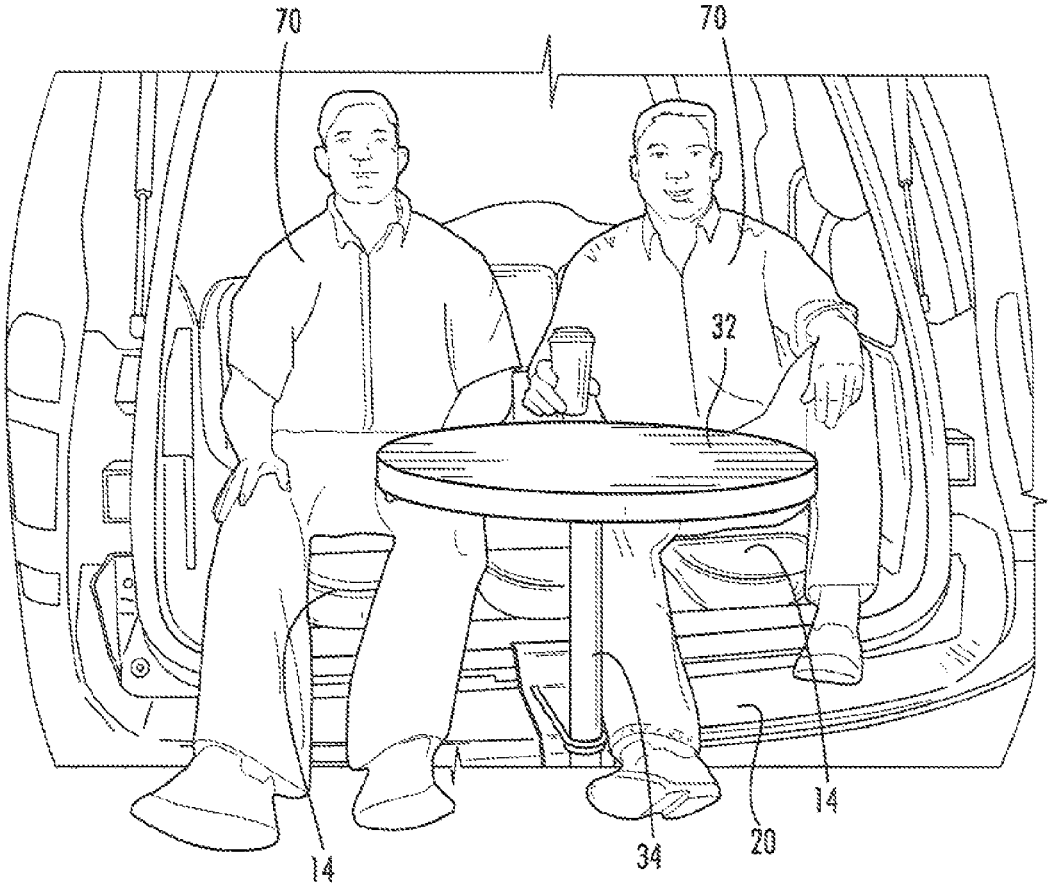
FIG. 4 is another perspective view of an exemplary embodiment of the mountable table on the rear of a vehicle.

Referring to FIGS. 1 through 4, the present disclosure provides a mountable recreation table 30 which can be easily be mounted and dismounted on the rear of a vehicle 10. The recreation table 30 includes a table top 32 and a table pole 34 attached to the underside of the table top 32 substantially near the center of the table top 32. The table top 32 is illustrated in FIGS. 1 and 4 with a round shape, but the table top 32 can also include a rectangular, square, oval, and the like shape. The table pole 34 is illustrated in FIGS. 1 through 4 with a cylindrical shape, but it can also be rectangular or square. The table top 32 and table pole 34 can be made of plastic, metal, or the like, and the same table top 32 and table pole 34 combination can be utilized in a plurality of vehicles 10.

The table pole 34 can be removable or rotatable from the table top 32. For example, the table pole 34 ears include an attachment means, such as a nut and bolt, screw, latch, pin, or the like, which secures the table pole 34 to the underside of the table top 32. A removable table pole 34 allows the table pole 34 and table top 32 to be separately stored in the rear of the vehicle 10. A rotatable table pole 34 allows the table pole 34 to be folded approximately 90 degrees to be substantially parallel to the table top 32, allowing the folded table pole 34 and table top 32 to be stored in the rear of the vehicle 10. For example, the table pole 34 and table top 32 can be stored in a rear compartment of the vehicle 10, such as under a load floor panel or on the side of the rear compartment. Alternatively, the table pole 34 can be fixed to the table top 32, such as by a weld, screws, or the like. The fixed table pole 34 and table top 32 can be stored in the rear compartment of the vehicle 10, such as laid down on its side or upside down with the table top 32 on a load floor panel in the rear compartment and the table pole 34 extending upward.

FIG. 1 illustrates an exemplary embodiment of the recreation table 30 mounted in the rear of the vehicle 10. The vehicle 10 can include a mini-van, sport utility vehicle (SUV), or the like. In FIG. 1, the vehicle 10 includes a set of rear seat backs 12 and rear seat bases 14. Alternatively, the vehicle 10 can include a load floor panel (not shown) in the rear compartment which can be sat on while the vehicle is parked. Additionally, the vehicle 10 includes a rear frame 20, such as a bumper, and a striker 24 located near the center of the rear frame 20 and is configured to secure a tailgate.

A table mount 40 is located on the rear frame 20. FIG. 2 illustrates a top perspective view of an exemplary embodiment of the table mount 40 located on the rear frame 20. The table mount 40 includes a distal end 42 and a proximal end 48 along with intermediate sections 44 and 48 between the ends 42 and 48. The proximal end 48 includes an opening sized to receive the striker 24 located on the vehicle 10. The proximal end 48 is placed over the striker 24, and an attachment device 60 can secure, the mount 40 to the striker 24 at the proximal end 24. For example, the attachment device 60 can include a block which slides into the striker 24, preventing the distal end 48 of the mount 40 from being removed from the striker 24. Alternatively, the striker 24 can be configured to rotate up to 90 degrees to also prevent the distal end 48 of the mount 40 from being removed from the striker 24. Other means, such as a latch, clamp, clasp, lock, or the like, can also he used as the attachment device 60 to secure the mount 40 to the rear frame 20. The table mount 40 can include a padding layer (not shown), such as rubber, felt, plastic, or the like, on the underside operable to protect the rear frame 20 of the vehicle 10 while the mount 40 is placed over it.

At the distal end 42, the table mount 40 includes a receiver 50 sized to receive the table pole 34. The distal end of the table pole 34 is placed into the receiver 50, and the receiver 50 holds a portion of the distal end of the table pole 34. The receiver 50 is hollow and substantially the same shape as the table pole 40, except slightly larger to allow the pole 40 to fit within the receiver 50. The receiver 50 has a height that covers a portion of the distal end of the table pole 34, and the height is sized to provide enough support for the table pole 34 and table top 32. The height of the receiver 50 is correlated to the weight of the table pole 34 and table top 32 to provide support for the pole 34 and top 32. Additionally, the receiver 50 can include securing means (not shown), such as a removable pin which is inserted into a hole in the receiver 50 and a hole in the table pole 34 or the like, to secure the pole 34 in the receiver 50.

The receiver 50 is physically attached to the mount 40 through, for example, a welded connection, screws, or the like. Alternatively, the receiver 50 and mount 40 are formed together in a single mold, such as molded steel, plastic, or the like. Additionally, a stabilizer beam 52 attaches near the top of the receiver 50 and extends to the section 46 of the mount 40. The stabilizer beam 52 provides horizontal support for the top of the receiver 50. In the example of FIG. 2, the stabilizer beam 52 includes two beams, such as wired metal beams, which attach to the section 46, and extend to wrap around the receiver 50. In another example, the stabilizer beam 52 can be a single beam extending from the receiver 50 to the section 46. Advantageously, the receiver 50 and the stabilizer beam 52 allow the mount 40 to secure the table pole 34 with only a single leg. Further the mount 40 is cost-effective, requiring no vehicle 10 modification to attach.

FIG. 3 illustrates a side perspective view of the mount 40, table pole 34, and the receiver 50 in an exemplary embodiment. The mount 40 is shaped substantially according to the shape of the rear frame 20 of the vehicle 10. For example, the proximal end 48 extends angled downward to match a slope of an edge 22 of the rear compartment of the vehicle 10. The section 46 extends over the edge 22 downward to the rear frame 20. The section 44 extends substantially horizontally outward on the rear frame 20. The distal end 42 extends downward over the rear frame 20, and outward extending beyond the rear frame 20. The receiver 50 is located on the outward extended portion of the distal end 42. Having the distal end 42 extend below and outward from the rear frame 20 provides additional support for the receiver 50 through the stabilizer beam 52. Accordingly, the mount 40 provides lateral support of the table pole 34 and top 32 through the distal end 42 and horizontal support through the stabilizer beam 52 and receiver 50.

The mount 40 and the associated sections 44 and 46 and ends 42 and 48 can be shaped differently according to the shape of the rear frame 20 and edge 22 of the vehicle 10. For example, the same table top 32 and pole 34 can be used in a plurality of vehicles 10 by implementing differently shaped mounts 40 customized to each of the vehicles 10. Advantageously, this allows a single table top 32 and pole 34 to be used with multiple vehicles 10 without requiring any modifications to the vehicles 10 to accommodate the table 30. Further, the mount 40 can be modified to secure in the rear of vehicles 10 which do not include the striker 24 (i.e., typically vehicles without a rear tailgate). For example, the mount 40 can be located on the rear frame 20, and include a securing means to attach and secure the mount to the rear frame 20.

If the vehicle 10 does not include the striker 24, the mount 40 can be modified to be secured to the seat backs 12, seat bases 14, rear frame 20, or the like. For example, the mount 40 can still be located on the rear frame 20, but the mount 40 can include a securing device to lock the mount in place, such as a strap or the like to lock the mount 40 on the rear frame 20.

FIG. 4 illustrates a perspective view of the rear of the vehicle 10 with two occupants 70 tailgating utilizing the table 30 while the vehicle 10 is parked with the tailgate open. As described herein, the table 30 can be utilized for tailgating, barbequing, games, camping, and the like while the vehicle 10 is parked. For example, the vehicle 10 can include seat bases 14 in the rear of the vehicle in a stadium position, such as Stow 'n Go seating available from DaimlerChrysler Corp. of Auburn Hills, Mich. The table 30 can be mounted to coordinate with these seat bases 14, allowing occupants 70 to enjoy activities such as tailgating.

As described herein, the table pole 34 can be removable or rotatable from the table top 32. The vehicle 10 can include a storage compartment for the table pole 34, table top 32, and mount 40 to be stored while the table 30 is not in use. For example, this storage compartment can be in the rear compartment underneath the load floor panel. Alternatively, the storage compartment can be underneath seats in the vehicle 10.

Advantageously, the present disclosure provides a mountable table 30 for the rear of the vehicle 10 which can easily and quickly mount and dismount while the vehicle 10 is parked, assisting in recreational activities. The location of the mount 40 can be coordinated with rear seat bases 14. Further, the mount 40 can be secured to the vehicle 10 without requiring any modification to the vehicle 10, and the mount 40 can be customized to be secured to a plurality of vehicles 10, allowing the same table 30 to be mounted on the plurality of vehicles 10.

Figure 5:
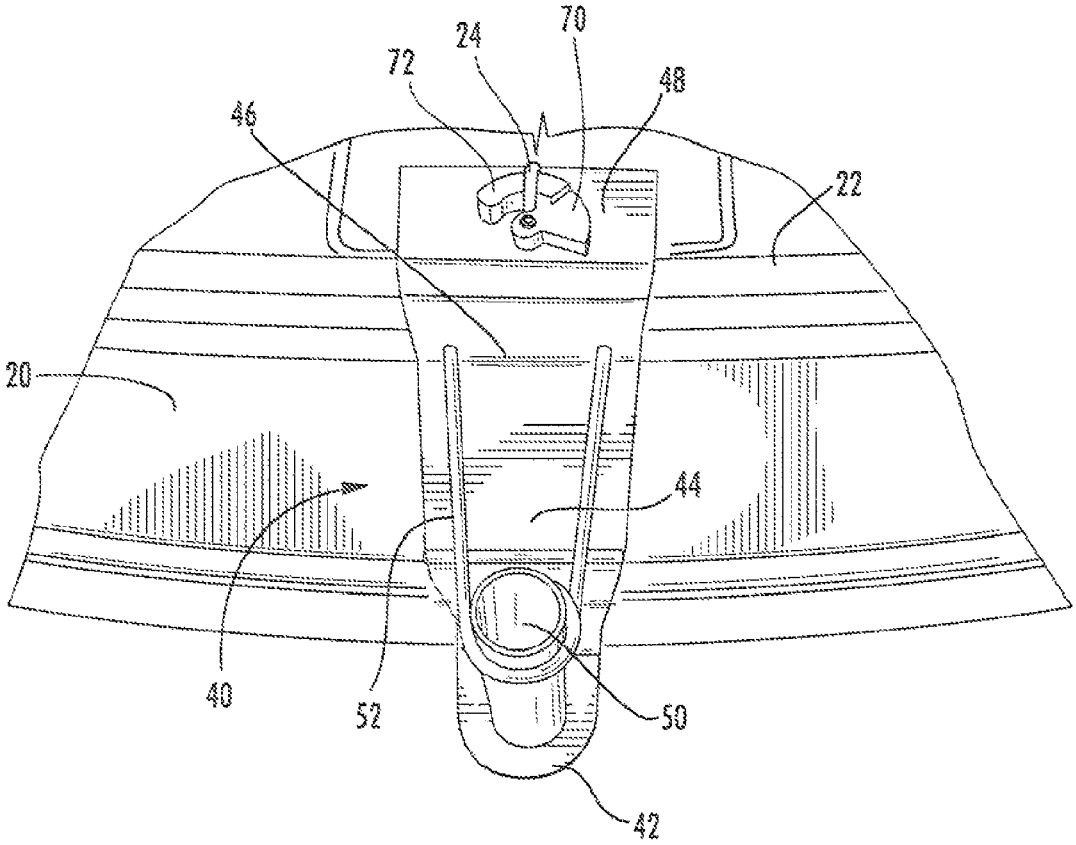
FIG. 5 is a perspective view of a latch connected to the table mount attached to the vehicle striker.
Figure 6:
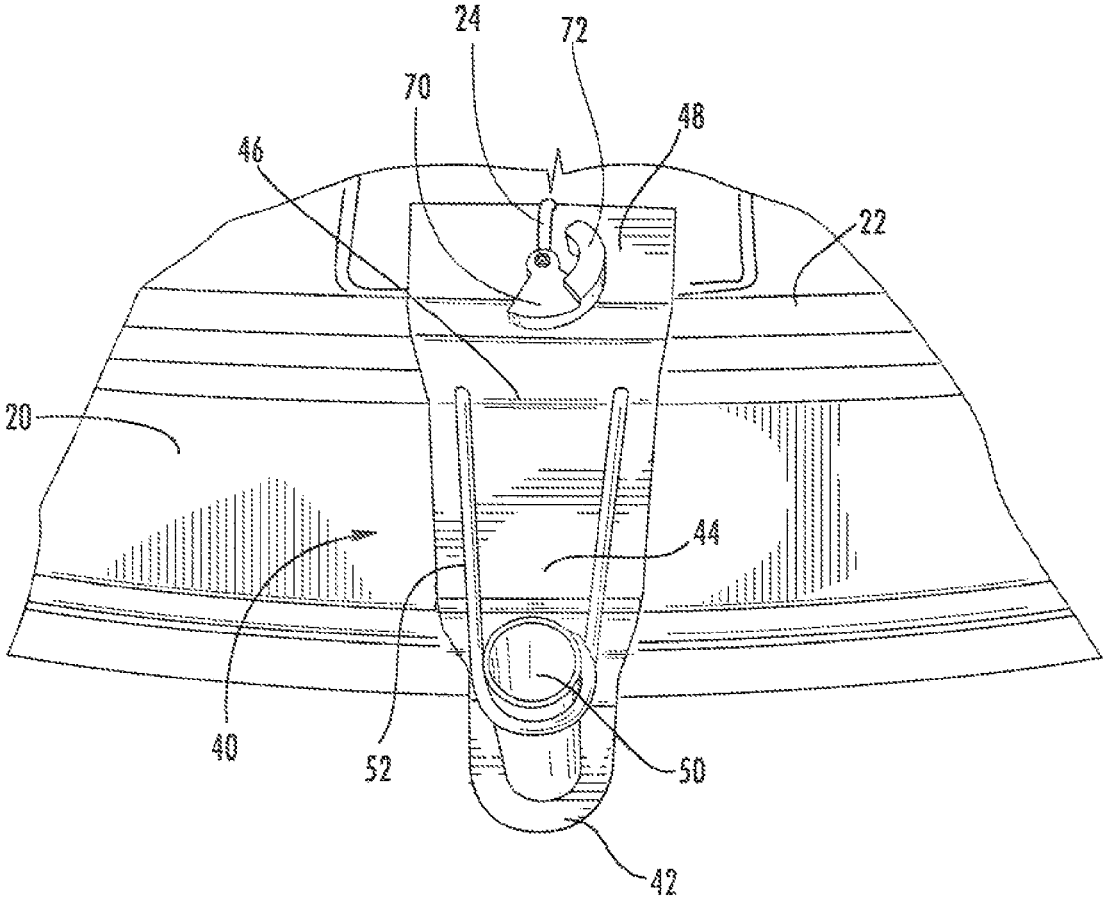
FIG. 6 is a perspective view of the latch depicted in FIG. 5 disconnected from the vehicle striker.
Figure 7:
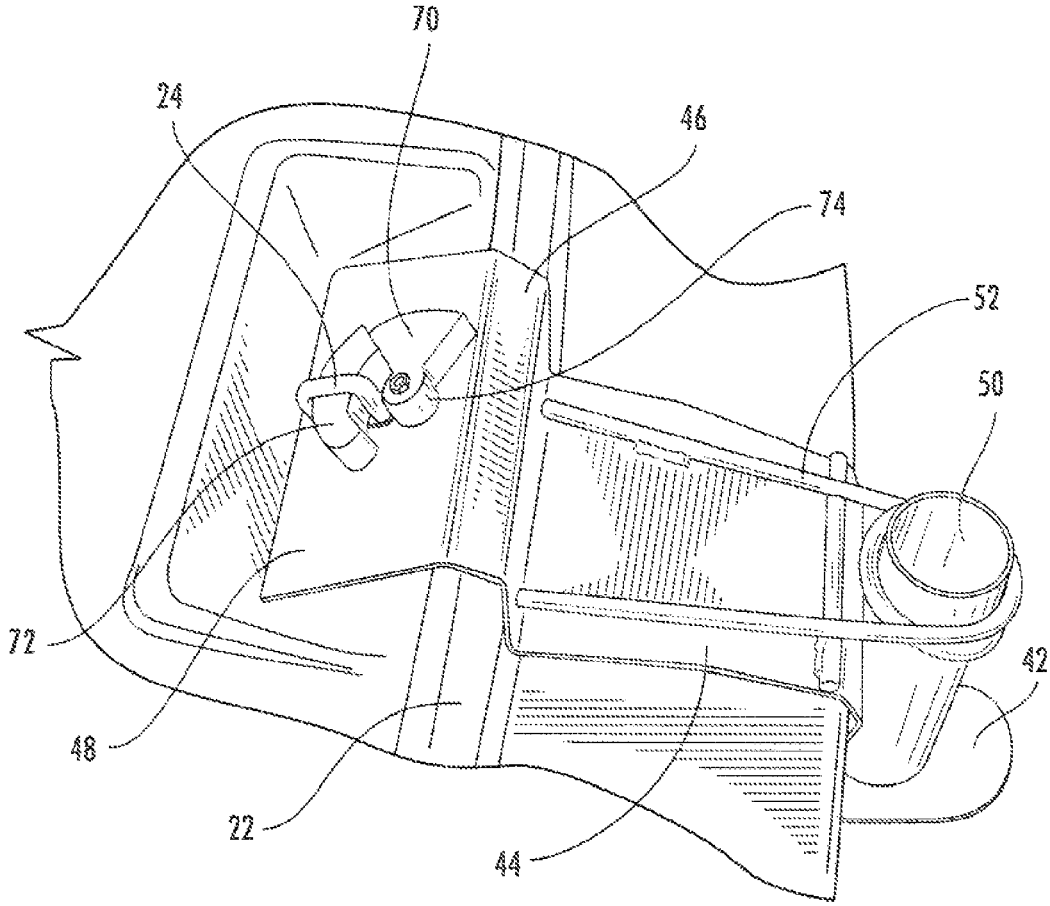
FIG. 7 is a side perspective view of the mount with the latch attached to the vehicle striker.

Referring to FIGS. 5 through 7, in an exemplary embodiment the mount 40 includes a latch 70 as an attachment device configured to secure the mount to the striker 24. The latch 70 is configured to rotate about a base 74, such as a pin connected to the base 74, to position a curved portion 72 of the latch inside the striker 24. The latch 70 can be configured to rotate to a first position, such as illustrated in FIG. 5, where the curved portion 72 is inside the striker 24, securing the mount 40 to the vehicle. Further, the latch 70 can be configured to rotate to a second position, such as illustrated in FIG. 6, where the curved portion 72 is removed from inside the striker 24, allowing the mount 40 to be removed from the an edge 22 of the rear compartment of the vehicle. The latch 70 can be configured to lock in position in the first and second position. FIG. 7 illustrates a side perspective view of the mount 40 attached to an edge 22 of the rear compartment of the vehicle and secured with the latch 70 to the vehicle striker 24. Advantageously, the latch 70 provides quick and easy means to secure the mount 40 to the vehicle without requiring any vehicle modification to receive the mount 40.

Although the present disclosure has been illustrated and described herein with reference to preferred embodiments and specific examples thereof, it will be readily apparent to those of ordinary skill in the art that other embodiments and examples may perform similar functions and/or achieve like results. Ail such equivalent embodiments and examples are within the spirit and scope of the present disclosure and are intended to be covered by the following claims.

What is claimed is:

1. A vehicle mountable table in combination with a vehicle having a rear frame with a generally horizontally extending portion, a generally vertically extending portion and a striker, comprising:

a table top;

a table pole attached to the underside of the table top;

a mount removably mountable to the rear frame of the vehicle, the mount comprised of one section configured for releasable engagement with the striker and another section carrying a receiver configured for releasably receiving the table pole; and wherein the table pole is attached on the underside of the table top substantially near the center.

2. The mountable table in combination with a vehicle of claim 1, further comprising a stabilizer beam extending from the receiver to one of the plurality of sections of the mount, wherein the stabilizer beam is operable to provide horizontal support to the receiver.

3. The mountable table in combination with a vehicle of claim 2, wherein the stabilizer beam comprises a wire beam which wraps around the receiver.

4. The mountable table in combination with a vehicle of claim 1, wherein the table pole is removable from the table top.

5. The mountable table in combination with a vehicle of claim 4, wherein the vehicle comprises a storage compartment for the table top, table pole, and mount.

6. The mountable table in combination with a vehicle of claim 1, wherein the table pole is rotatable about the underside of the table top.

7. The mountable table in combination with a vehicle of claim 1, wherein the mount is located on the rear frame of the vehicle, and wherein the mount attaches to the rear frame without requiring modification of the vehicle.

8. The mountable table in combination with a vehicle of claim 1, wherein the vehicle comprises seats in the rear compartment, and wherein the mountable table is located to coordinate with the seats.

9. The mountable table in combination with a vehicle of claim 1, wherein the one section of the mount comprises a proximal section that overlies an edge of a rear compartment of the vehicle that is configured for removable receipt of the striker, the another section of the mount comprises distal section that extends generally outwardly from the rear frame of the vehicle that carries the carrier, and wherein the mount further comprises a plurality of sections intermediate the proximal and distal sections with one of the plurality of intermediate sections extending generally horizontally and overlying a generally horizontal portion of the rear frame of the vehicle, and another one of the plurality of intermediate sections extending generally vertically downwardly along a generally vertical portion of the rear frame of the vehicle.

10. The mountable table in combination with a vehicle of claim 9, wherein the distal section of the mount extends outwardly from at or adjacent a bottom portion of the generally vertically downwardly extending intermediate section of the mount.

11. A method for removable mounting of a table on the rear of a vehicle, comprising:

(a) opening a rear tailgate on the vehicle;

(b) placing a mount on a rear frame of the vehicle, wherein an opening in a proximal end of the mount is placed over a striker in a vehicle rear compartment, and a distal end of the mount extends outward from the rear frame of the vehicle;

(c) securing the mount to the striker;

(d) placing a table pole in a receiver located on the distal end of the mount; and (e) attaching a table top to the table pole.

12. The removable table mounting method of claim 11, further comprising:

removing the table pole from the receiver;

un-securing the mount from the striker;

removing the mount from the rear frame of the vehicle; and storing the table pole, mount, and the table top connected to the table pole in the vehicle.

13. The removable table mounting method of claim 12, wherein the storing step comprises rotating the table pole to be substantially parallel with the table top, and storing the table top with the table pole folded against the top in the vehicle.

14. The removable table mounting method of claim 12, wherein the storing step comprises removing the table pole from the table top, and storing the table top, table pole in the vehicle.

15. A mount for securing a table to the rear of a vehicle in combination with the vehicle, comprising:

a distal end comprising a receiver, wherein the receiver extends substantially perpendicular from the distal end and comprises a receiver opening operable to receive a pole;

a plurality of intermediate sections extending from the distal end to a rear frame of the vehicle;

a proximal end connected to the plurality of intermediate sections, wherein the proximal end comprises a securing opening which is placed over a striker in the vehicle; and a stabilizer beam connected to the receiver and one of the plurality of intermediate sections.

16. The mount and vehicle combination of claim 15, further comprising:

a table pole attached to the underside of a table top;

wherein the table pole is placed in the receiver opening.

17. The mount and vehicle combination of claim 15, wherein the mount is secured to the rear frame of the vehicle with an attachment device operable to secure the securing opening.

18. The mount and vehicle combination of claim 17, wherein the attachment device comprises a latch connected to the proximal end, and wherein the latch comprises a curved portion configured to rotate to fit within the striker in a first position and to rotate out of the striker in a second position.

* * * * *